United States Patent [19]

Lin et al.

[11] Patent Number: 4,915,642

[45] Date of Patent: Apr. 10, 1990

[54] TROUBLE-FREE CONNECTOR WITH LOCK MECHANISM

[75] Inventors: Chen-Chih Lin; Tien-Chih Hsing, both of Taipei, Taiwan

[73] Assignee: Pan-International Industrial Corporation, Hsintien Taipei, Taiwan

[21] Appl. No.: 299,056

[22] Filed: Jan. 19, 1989

[51] Int. Cl.[4] ..... H01R 13/627

[52] U.S. Cl. ..... 439/352; 439/350; 439/357

[58] Field of Search ..... 439/350, 353, 355, 357, 439/352, 354, 358

[56] References Cited

FOREIGN PATENT DOCUMENTS 845697 8/1960 United Kingdom ..... 439/350

*Primary Examiner*—Steven C. Bishop

*Attorney, Agent, or Firm*—Leonard Bloom

[57] ABSTRACT

A tubular body has rectangular-shaped slot formed in the top portion thereof, and matched eccentric convex protrusions are formed on both sides of the body. A core is provided with a concave-shaped groove on its surface that is matched with the slot, when the core is inserted into the body. A cable is connected to the core. A rear cup is tightly fitted to the rear end of the body for securing the cable that is disposed externally through the hole. An insulation shell is tightly shielded on the outer rim of the rear cup and has an enclosed protrusion stopper. A locking device is provided which mates with the slot of the body. The locking device is furnished with ring-shaped side wings that ride on the body and touch the protrusions which serve as a force-receiving point. A coil spring is inserted from the rear end of the body and is located in between the locking wings and the rear cup. A slider is provided which can accommodate the locking wings of the device. Inside the slider a driving block is furnished being positioned in front of the wings of the locking device. The assembly on the outer rim of the device and the spring produces normal disengagement through the actuation of the spring via the locking wings of device. After coupling, the plug is easily matched with the insertion slot on the front side of the socket, thereby producing the locking action.

7 Claims, 5 Drawing Sheets

TROUBLE-FREE CONNECTOR WITH LOCK MECHANISM

FIELD OF THE INVENTION

The present invention relates to a trouble-free connector with lock mechanism, that is relatively simple in construction, easy to operate, durable and free from premature disengagement.

BACKGROUND OF THE INVENTION

The present invention relates to a trouble-free connector with lock mechanism, which in particular, is relatively simple in structure and can be easily and quickly coupled and uncoupled.

Owing to the high development of computer hardware, the electrical connector, one of the basic parts in electronic transmission, has become smaller in volume and more reliable in computerized and electronic communication, thereby effectively saving assembling and operating space and preventing the delivery of electrical signals and computerized information from interruption. French Pat. No. 1455850; German Pat. No. 2063258; Japanese Laid-Open Utility Model Publication No. 53-110489 and French Pat. No. 2447103 have already revealed electrical connectors that, when a plug and a socket are coupled with each other, a lock mechanism is automatically actuated to insure the coupling of the plug and the socket, free from abnormal disengagement problems. But, these connectors are still in the "in-the-work" stage, are not practical and have some drawbacks, such as: in Japanese Laid-Open Utility Model Publication No. 53-110489, it is not possible to connect the plug and the socket while holding the coupling sleeve, thereby making the coupling operation very inconvenient.

An improvement on the functions of the existing connectors is disclosed in Republic of China patent application Ser. No. 7325709 entitled "Connector with lock mechanism" (see FIGS. 2 & 3). However, that connector still has the following disadvantages: (1) it is too complicated to be economically put into production because (a) it is equipped with a coupling sleeve 1, a locking spring 2, a pair of support bars 3, engagement members 4 and a coil spring 5 and (b) it is limited in construction due to space requirements necessary for axially disengaging the bar 3 from the insertion slot 6 while the protrusion 2*a* is located on and radially engages the locking recess 7. In this position, since the spring 2 springs back, the value d1, which is the sum of thickness of the protrusion 2*a* of the spring 2 and the bar 3, must be greater than the width d2 of the slot 6; (2) it can easily malfunction due to defects in the actuating process that arise from the bad effects to the spring 5, the bars 3, and the other contacting portions, which damage and shorten the service life of the whole plug and socket, due to the force of impact resulting from the injecting action of the bar 3 which is hastily injected into the space of the slot 6 when the spring 2 automatically springs back with an actuating injection force towards the spring 5. This occurs when the spring 2 has accomplished the engagement into the recess 7 when coupling the plug and the socket; and (3) a secondary locking action is required to finish both the locking action after the spring 2 has been fully injected into the recess 7 and the secondary disengaging action after the bar 3 has been fully pulled out from the slot 6. Therefore, total locking and engaging procedures and operations are relatively long and complicated.

SUMMARY OF THE INVENTION

In light of the above-mentioned disadvantages of the known electrical connectors, disclosed herein is a compact, durable and quick-to-operate connector with lock mechanism. Such an electrical connector provides the best quality and highest stability in electronic communication as noted earlier. Furthermore, the main objects and advantages of the present invention are to provide a compact, easy-to-operate means, that absorbs the external sources that are harmful to said connector, and that prevents the connection from damage due to the operation processes. Another advantage of the present invention is that it is very concise and easy to mass produce. The above and other objects, features and advantages of the present invention will become more apparent from the following description, when taken in conjunction with the accompanying drawings in which preferred embodiments of the present invention are shown by way of illustrated example.

BRIEF DESCRIPTION OF THE DRAWINGS

FIGS. 5-1 through 5-6 illustrate the actuation process during engagement and disengagement of the electrical connector of the present invention.

FIG. 5-1 is a cross-section view of the electrical connector of the present invention before being operated.

FIG. 5-2 is a cross-section view of the electrical connector of the present invention after being engaged.

FIG. 5-3 is a cross-section view of the electric connector of the present invention after being coupled by the locking action.

FIG. 5-4 is a cross-section view of the electric connector of the present invention after being uncoupled by the disengaging action.

FIG. 5-5 is a cross-section view of the electric connector of the present invention after removing the plug from the socket.

FIG. 5-6 is a cross-section view of the electric connector of the present invention after completely removing the plug from the socket and restoring the plug to the original state.

DESCRIPTION OF THE PREFERRED EMBODIMENTS

Figure 1:
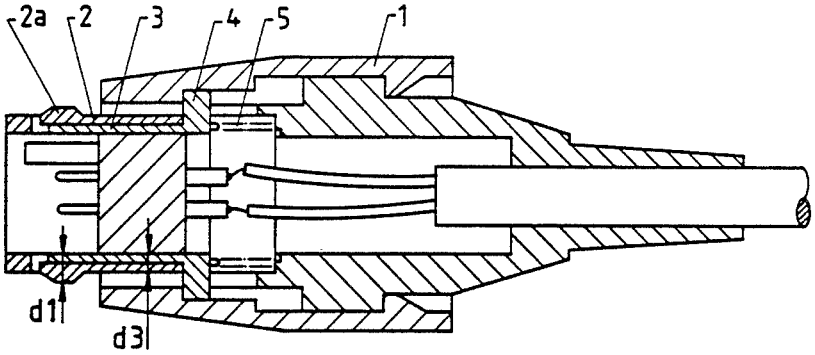
FIG-1 PRIOR ART
FIG. 1 is a side view, in cross-section of the electrical connector disclosed in R.O.C. patent application No. 7325709 entitled "Connector with lock mechanism".
Figure 1A:
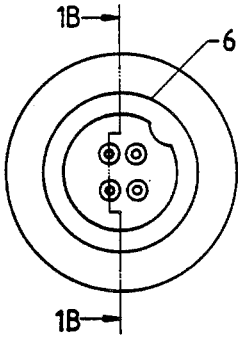
FIG-1A PRIOR ART
FIG. 1A is an end view of the electrical connector to be coupled with FIG. 1.
Figure 1B:
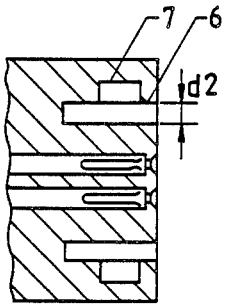
FIG-1B PRIOR ART
FIG. 1B is a cross-section view taken along line 1B—1B of FIG. 1A.
Figure 2:
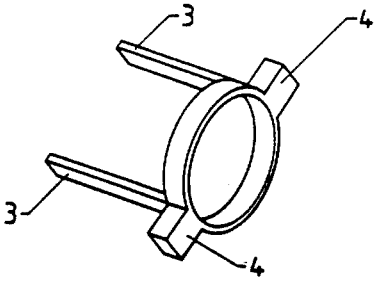
FIG-2 PRIOR ART
FIG. 2 is a perspective view of the support bar of the electrical connector of FIG. 1.
Figure 3A:
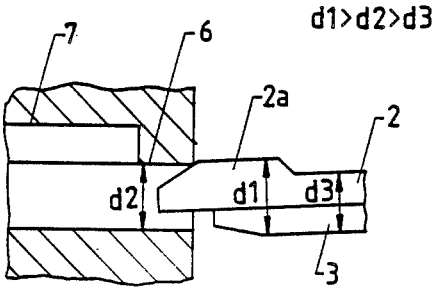
FIG-3a PRIOR ART
FIGS. 3(*a*) through 3(*d*) illustrate the locking and disengaging actuation processes of the electrical connector of FIG. 1.
Figure 3C:
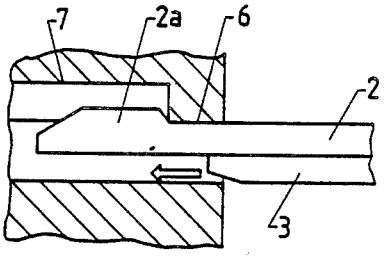
FIG-3c PRIOR ART
Figure 3B:
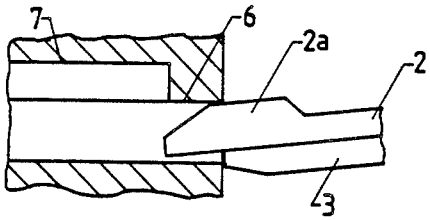
FIG-3b PRIOR ART
Figure 3D:
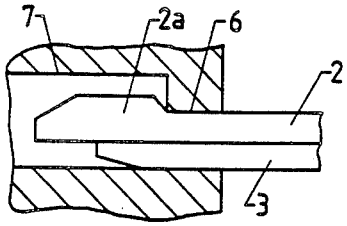
FIG-3d PRIOR ART
Figure 4:
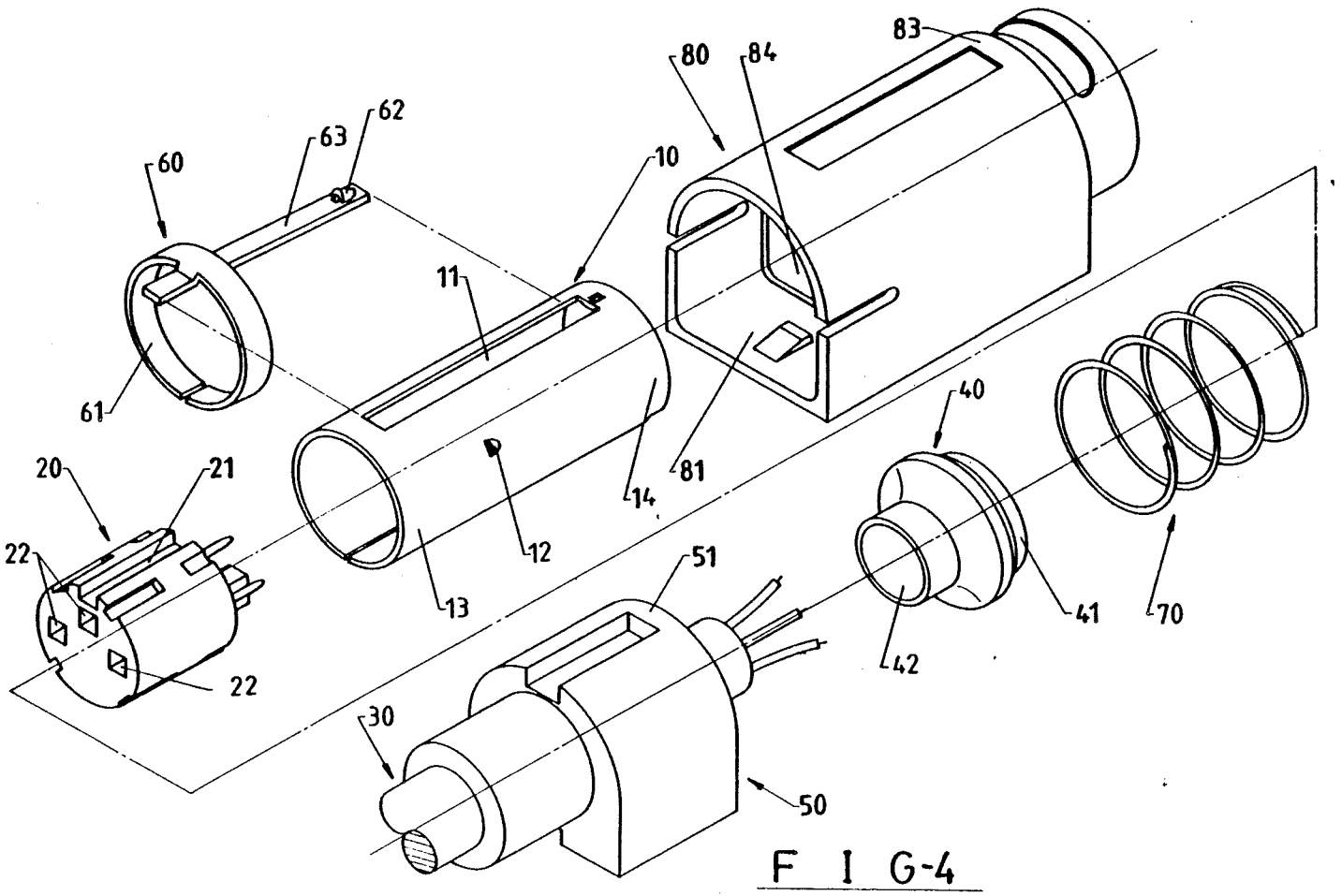
FIG. 4 is an exploded view, in perspective, of the electrical connector of the present invention.
Figures 1, 5:
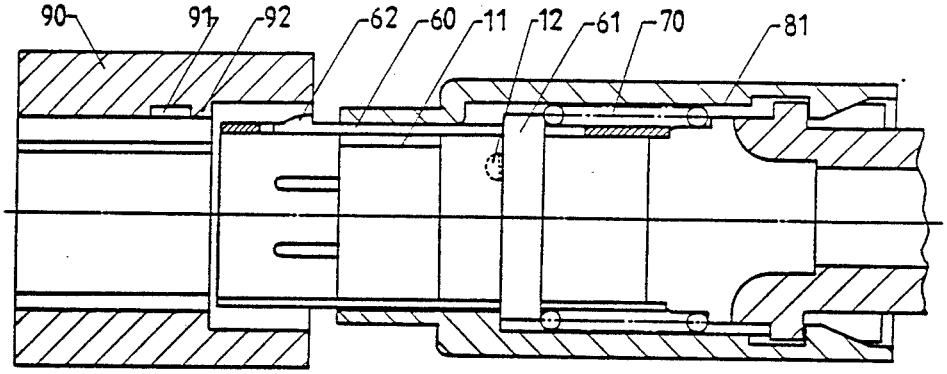
Figures 2, 5:
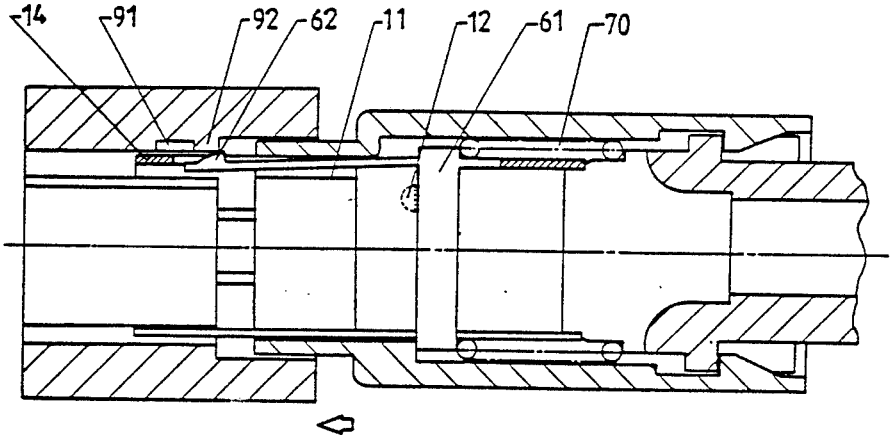
Figures 3, 5:
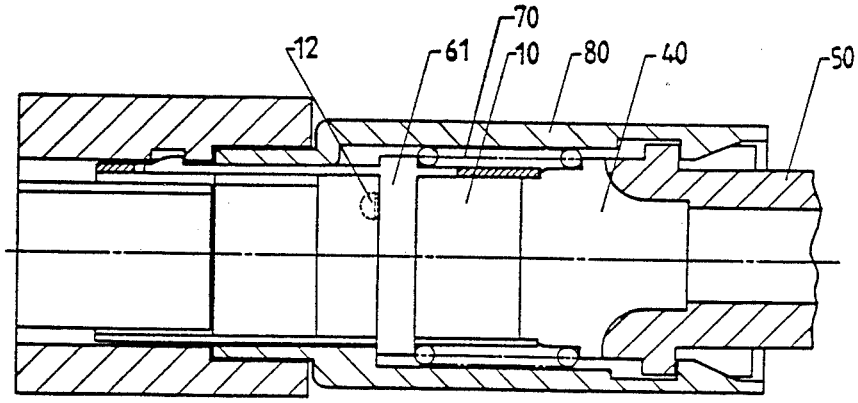
Figures 4, 5:
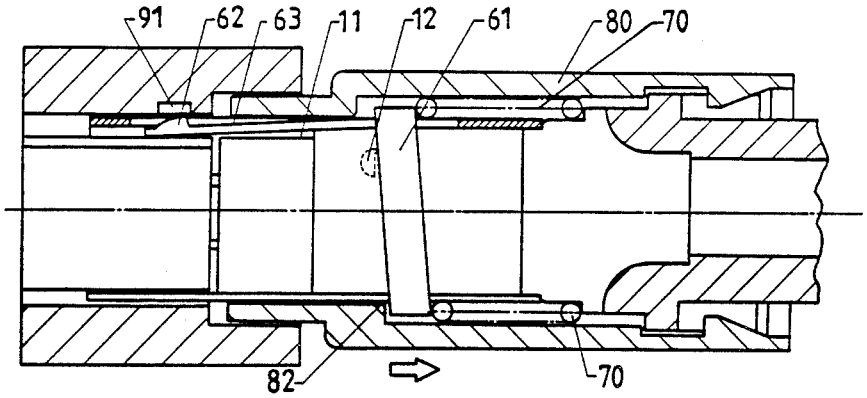
Figure 5:
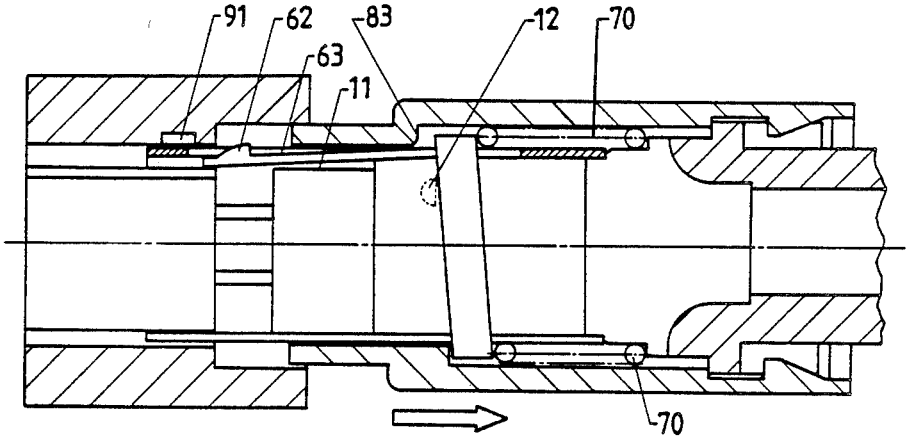
Figures 5, 6:
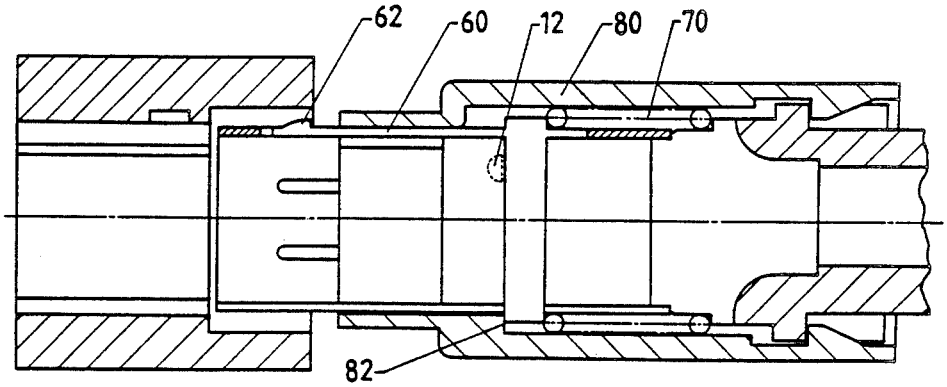

Referring now to FIGS. 4 and 5, the electrical connector with lock mechanism of the present invention, consists of a tubular body 10 having a rectangular-shaped slot 11 formed in the top portion thereof, and matched eccentric convex protrusions 12 are formed on both sides of the body 10. A support core 20 is provided which is furnished with a concave-shaped groove 21 on its surface that is matched (aligned) with the slot 11 when the core 20 is inserted into the body 10. A cable 30 is connected to the core 20 by means of crimping terminals 22. A rear cup 40 is tightly fitted by seal 41 to the rear end 13 of the body 10 for securing the cable that is disposed extending through hole 42. An insulation shell 50 is tightly shielded on the outer rim of the rear cup 40 and has an enclosed protrusion stopper 51. A locking device 60 is provided which mates with the slot 11 of the body 10. The locking device 60 is furnished with ring-shaped side wings 61 that ride on the body 10 and touch (abut) protrusions 12 which serve as a force-receiving point. A coil spring 70 is inserted from the rear end 13 of the body 10 and is located between the locking wings 61 and the rear cup 40. A slider 80 is provided which can integrally accommodate the wings 61 of the device 60. Inside the slider 80, a drive block 82 is furnished, being positioned in front of the wings 61 of the locking device 60 when assembled. This block 82 produces normal engagement through the actuation of the spring 70 via the locking wings 61 of the device 60. After coupling, the plug can be easily matched with the insertion slot 91 on the front side of the socket 90, thereby producing the locking action. All of the above descriptions are the preferred embodiment for the connector with lock mechanism manufactured according to this present invention. Referring now to FIG. 5, the operation of the electrical connector for actuation for both locking and engaging (coupling) and disengaging (uncoupling) is illustrated. The electrical connector of the present invention exhibits the following advantages: (1) it is simple in structure and only comprises three units: the locking device 60, the spring 70 and the slider 80, in which the main actuation element for both locking and disengaging can be easily and directly accomplished, through the simple driving action of the strong and compact locking device 60 by drive block 82. This makes operation of the connector very easy, quick and effective and eliminates the malfunction rate of the connector. Also, the high productivity of mass production and better quality can be easily accomplished; and (2) it is very easy to operate after coupling. Coupling occurs as follows: (a) the wings 61 are vertically positioned on the axial outside of the body 10, and locking arm 63 has fallen into the slot 11 of the body 10. On the arm 63, the locking protrusion 62 is located forward thereof (FIG. 5-1); at the front end; (b) the front end 14 of the body 10 passes the slot 91 and the protrusion 62 on the front end of the locking arm 63 touches the outer ring stopper 92 of the slot 91 in the socket 90 when the user plugs the body 10 into the socket 90. At that time, the locking arm 63 is downwardly and inclinatedly drived into the slot 91 of the socket 90 because the plug-in action is restrained causing the spring 70 to be eccentrically compressed through the rebounding reaction of the protrusion 62, the wings 61 and the protrusion 12 of the body 10 (FIG. 5-2); (c) both the body 10 and the socket 90 are coupled together when the user continues the plug-in procedure. Meanwhile, the device 60 is restored to its original state and the protrusion 62 is automatically lifted and put into the slot 91 of the socket 90 to accomplish the locking action, due to the protrusion 62 of the device 60 passing through the barrier of the stopper 92 and receiving the rebounding force of the spring 70. At this moment, outer force passes through the cable 30, the shell 60, the rear cup 40, the body 10 and the protrusion 12, being transmitted to the protrusion 62 of the locking device 60 and being absorbed by the stopper 92 in the front of the slot 91 when outer force actuates the cable 30 due to the tightly locking action between the protrusion 62 and the slot 91. Therefore, the interruption problem in communication is easily prevented (FIG. 5-3); (d) the user can only hold the slider 80 and pull backwardly, then, the drive block 82 actuates the wings 61 of the device 60 and pulls the protrusion 62 being disengaged from the slot 91 by means of the backward and downward eccentric movement producing the disengaging action for pulling the body 10 out from the socket 90 (FIG. 5-4); (e) the body 10 and the protrusion 62 are completely pulled out from the socket 90 due to the actuation between the front end 83 in the hollow space 81 of the slider 80 and the protrusion 12, directly through the matched moving action between the concave ring recess at the space 84 of the slider 80 and the stopper 51 of the shell 50 in case of continuing the pulling procedure for the body 10 (FIG. 5-5); and (f) the locking device 60 and the slider 80 are easily restored to the original state as shown in FIG. 5-1 through the reaction of the spring 70.

Based on the above descriptions, the electric connector according to the present invention is simple in construction, effective, and easy to operate, the locking action is quickly accomplished while coupling; the disengaging action is also quickly accomplished by pulling the slider 80 out. Also, the locking device 60 is relatively durable and the normal actuation adopted is the swinging and declining style which is very safe and force-saving. Therefore, the electrical connector of the present invention is durable, practical, useful and economical.

We claim:

1. An electrical connector having a lock mechanism, the connector comprised of:

a tubular body having a top portion, a rear end and a pair of opposite sides, the top portion having a rectangular-shaped slot formed therein;

a pair of matched eccentric convex protrusions, each protrusion located on a respective side of the tubular body;

a support core slidably disposed in the tubular body, the support core including a surface having a concave-shaped groove formed therein, such that when the support core is slidably disposed in the tubular body, the concave-shaped groove is substantially aligned with the slot formed in the top portion of the tubular body;

the support core further including a plurality of crimping terminals;

a cable secured to the crimping terminals, whereby the cable is connected to the support core;

a rear cup having an outer rim, the rear cup being fitted to the rear end of the tubular body, the rear cup having a hole formed therethrough in which the cable is received and secured;

an insulation shell secured on the outer rim of the rear cup, the insulation shell including a protrusion stopper;

a locking device having a pair of ring-shaped side wings that are received around and ride on the tubular body, so that the respective side wings abut the respective protrusions formed on the tubular body, thereby defining a force receiving point, the locking device further including an arm integral with the side wings and extending forwardly therefrom, the arm being sized and shaped so as to mate with the slot formed in the body of the tubular member;

a coil spring disposed on the rear end of the tubular body between the side wings of the locking device and the rear cup;

a slider for slidingly accommodating the tubular body, the support core, the locking device, the coil spring, the rear cup and at least part of the insulation shell, the slider including an internal drive block located forwardly of the side wings of the locking device when the locking device is disposed in the slider, whereby normal disengagement is permitted through actuation of the coil spring via the side wings of the locking device;

a socket including a front side, the front side having an insertion slot formed therein; and wherein after engagement, the plug may be matched with the insertion slot formed in the front side of the socket, thereby producing the locking action.

2. The electrical connector having a lock mechanism of claim 1, wherein the coil spring is disposed on the rear end of the tubular body between the side wings of the locking device and the rear cup.

3. The electrical connector having a lock mechanism of claim 1, wherein the arm of the locking device has a locking protrusion formed thereon remote from where the arm is integral with side wings, the arm of the locking device being sized and shaped to mate with the slot formed in the body of the tubular member, so that said arm falls into the slot with the locking protrusion of the arm extending above the top portion of the tubular body.

4. The electrical connector having a lock mechanism of claim 1, wherein the pair of eccentric convex protrusions formed on the tubular body are substantially semi-circular in shape.

5. The electrical connector having a lock mechanism of claim 1, wherein the slider has a concave circular groove formed therein, thereby defining a semi-circular recess that encloses the protrusion stopper of the insulation shell and permits control of the movement of the slider.

6. The electrical connector having a lock mechanism of claim 1, wherein a space is maintained between the front end of the slider and the side wings of the locking device in order to prevent the front end of the slider from being touched by the matched eccentric convex protrusions during the movement of the slider.

7. The electrical connector having a lock mechanism of claim 6, wherein the space between the front end of the slider and the side wings of the locking device is kept as small as possible, so as to allow the matched eccentric convex protrusions of the tubular body to touch the space during movement of the slider.

* * * * *